US012239248B2

(12) United States Patent
Faramarzi et al.

(10) Patent No.: US 12,239,248 B2
(45) Date of Patent: Mar. 4, 2025

(54) GRID INTERACTIVE MICRO-DISTRIBUTED REFRIGERATED DISPLAY CASE

(71) Applicant: Alliance for Sustainable Energy, LLC, Golden, CO (US)

(72) Inventors: Ramin Teimouri Faramarzi, Pacific Palisades, CA (US); Sammy Houssainy, Mission Viejo, CA (US); Jason David Woods, Boulder, CO (US); Eric Kozubal, Superior, CO (US)

(73) Assignee: Alliance for Sustainable Energy, LLC, Golden, CO (US)

( * ) Notice: Subject to any disclaimer, the term of this patent is extended or adjusted under 35 U.S.C. 154(b) by 69 days.

(21) Appl. No.: 17/697,126

(22) Filed: Mar. 17, 2022

(65) Prior Publication Data

US 2022/0299242 A1 Sep. 22, 2022

Related U.S. Application Data

(60) Provisional application No. 63/162,074, filed on Mar. 17, 2021.

(51) Int. Cl.
*A47F 3/04* (2006.01)
*F25B 7/00* (2006.01)
(Continued)

(52) U.S. Cl.
CPC ..... *A47F 3/0443* (2013.01); *F25B 7/00* (2013.01); *F25B 25/005* (2013.01); *F25D 16/00* (2013.01);
(Continued)

(58) Field of Classification Search
CPC ..... A47F 3/0443; A47F 3/0439; F25D 17/02; F25D 16/00; F25B 2400/22
See application file for complete search history.

(56) References Cited

U.S. PATENT DOCUMENTS 2,883,836 A 4/1959 Sacks
2,952,992 A * 9/1960 Voorhies ..... A47F 3/0443 62/251
(Continued)

FOREIGN PATENT DOCUMENTS

NL 7908309 A 6/1981
WO 2012/161718 A1 11/2012

OTHER PUBLICATIONS

International Search Report and Written Opinion for International (PCT) Application No. PCT/US22/20701, Date of Mailing—Jun. 22, 2022, pp. 1-9.
(Continued)

*Primary Examiner* — Christopher R Zerphey
(74) *Attorney, Agent, or Firm* — Alexandra M. Hall; Michael A. McIntyre

(57) ABSTRACT

The present disclosure relates to an improved open vertical display case (OVDC) which utilizes radiant cooling to cool and/or maintain food products at a target temperature. The radiant cooling is performed using a plurality of piping routed through the walls and containing a first refrigerant stream. The plurality of piping may be cooled using a refrigeration circuit. In some embodiments, a phase change material may be used for thermal energy storage and positioned between the plurality of piping and the refrigeration circuit. In some embodiments, the refrigeration circuit may be connected to heating ventilation and air conditioning (HVAC) systems and water heating systems within the building.

14 Claims, 6 Drawing Sheets

(51) Int. Cl.

| | |
|---|---|
| ***F25B 25/00*** | (2006.01) |
| ***F25D 16/00*** | (2006.01) |
| ***F25D 17/02*** | (2006.01) |

(52) U.S. Cl.
CPC ..... *F25D 17/02* (2013.01); *F25B 2400/22* (2013.01); *F25B 2400/24* (2013.01)

(56) References Cited

U.S. PATENT DOCUMENTS

| | | | | |
|---|---|---|---|---|
| 4,150,551 | A | 4/1979 | Eisler | |
| 4,210,000 | A * | 7/1980 | Lee | F25D 17/08 62/417 |
| 4,280,335 | A * | 7/1981 | Perez | F25D 16/00 62/332 |
| 4,951,481 | A * | 8/1990 | Negishi | F25D 16/00 62/438 |
| 5,315,837 | A * | 5/1994 | Lego | F25D 15/00 34/294 |
| 5,381,670 | A * | 1/1995 | Tippmann | F25D 16/00 62/434 |
| 5,911,744 | A * | 6/1999 | Kawaguchi | A47F 3/0443 62/434 |
| 6,742,353 | B2 | 6/2004 | Ohashi et al. | |
| 6,886,359 | B2 * | 5/2005 | Yamazaki | F25D 21/04 454/193 |
| 7,137,438 | B2 * | 11/2006 | Nomura | F25D 25/02 62/251 |
| 9,360,236 | B2 * | 6/2016 | Stewart | F25B 30/06 |
| 9,370,262 | B2 | 6/2016 | Wirth | |
| 9,775,448 | B2 | 10/2017 | Wood et al. | |
| 10,648,743 | B2 | 5/2020 | Kozubal et al. | |
| 2003/0037559 | A1 | 2/2003 | Lane et al. | |
| 2005/0081551 | A1 | 4/2005 | Dail | |
| 2007/0056312 | A1 | 3/2007 | Kobayashi | |
| 2009/0064707 | A1 | 3/2009 | Smith et al. | |
| 2010/0083687 | A1 | 4/2010 | Handa et al. | |
| 2010/0212343 | A1 * | 8/2010 | Swofford | A47F 3/0491 62/251 |
| 2015/0297000 | A1 | 10/2015 | Gomes et al. | |
| 2020/0200461 | A1 * | 6/2020 | Dube | F25B 41/00 |

OTHER PUBLICATIONS

"Performance Comparison of Three High Efficiency Medium-Temperature Display Cases", available at https://www.etcc-ca.com/sites/default/files/reports/et_06.07_mt_display_cases.pdf, Jun. 22, 2009, accessed Jun. 7, 2022, pp. 1-101.

Aljehani et al., "Design and Optimization of a Hybrid Air Conditioning System with Thermal Energy Storage Using Phase Change composite", Energy Conversion and Management, 2018, vol. 169, pp. 404-418.

Amin et al., "Comprehensive study on the effects of fluid dynamics of air curtain and geometry,on infiltration rate of open refrigerated cavities", Applied Thermal Engineering, 2011, vol. 31, pp. 3055-3065.

Chaomuang et al., "A simplified heat transfer model of a closed refrigerated display cabinet", Thermal Science and Engineering Progress, Jun. 2020, vol. 17, No. 100494, pp. 1-12.

Gin et al., "The use of PCM panels to improve storage condition of frozen food", Journal of Food Engineering, 2010, vol. 100, No. 2, pp. 372-376.

Navaz et al., "Jet entrainment rate in air curtain of open refrigerated display cases", International Journal of Refrigeration, Mar. 2005, vol. 28, Issue 2, pp. 267-275.

Jackson, "Evaluating Supermarket Energy Management Strategies", Emerson—Climate Conversations, Jan. 14, 2020, available at https://emersonclimateconversations.com/2020/01/14/evaluating-supermarket-energy-management-strategies/, accessed Jun. 7, 2022, pp. 1-3.

Laguerre et al., "Heat transfer modelling in a refrigerated display cabinet: The influence of operating conditions", Journal of Food Engineering, Jan. 2012, vol. 108, No. 2, pp. 353-364.

Shin et al., "Cooling Capacity and Energy Performance of Open-TypeCeiling Radiant Cooling Panel System with Air Circulators", Energies, 2021, vol. 14, No. 5, pp. 1-15.

* cited by examiner

GRID INTERACTIVE MICRO-DISTRIBUTED REFRIGERATED DISPLAY CASE

CROSS-REFERENCE TO RELATED APPLICATIONS

This application claims priority to U.S. Provisional Patent Application No. 63/162,074 filed on Mar. 17, 2021, the contents of which are incorporated herein by reference in their entirety.

CONTRACTUAL ORIGIN

This invention was made with United States government support under Contract No. DE-AC36-08GO28308 awarded by the U.S. Department of Energy. The United States government has certain rights in this invention.

BACKGROUND

With 40-60 kWh/sf-year electric usage intensity (EUI), supermarkets (i.e., grocery stores) have one of the highest EUIs of any commercial buildings. Refrigeration accounts for approximately 50% of the electric energy used by supermarkets. Medium temperature refrigerated open vertical display cases (OVDCs) comprise nearly 50% of total OVDC line-ups in a typical supermarket, with more than 80% of their energy usage attributed to infiltration of air from the surrounding space (i.e., air at ambient conditions within the supermarket). OVDCs primarily use air to extract heat via convective heat transfer.

Typical OVDCs use a constant-volume fan to discharge refrigerated air from a grille at the top front of the case. This refrigerated jet of air removes heat from the case and entrains warm, moist air from the supermarket ambient before returning to the evaporator via a grille at the bottom of the case. At the same time, a large portion of the case's cold air mixes with the adjacent sales area's air and spills out in front of the case. As the return air travels across the cold evaporator (maintained at approximately 19° F.), it deposits its moisture as frost. The heat of refrigeration is typically rejected to the supermarket ambient and not recovered. The entrainment of warm and moist air into the case dominates the case's heat gain and results in a total cooling load of approximately 1,300 Btu/hr-ft$^2$. The high energy use due to air at supermarket ambient temperatures accounts for approximately 80% of the cooling load in this design. The front formation on the evaporator restricts air flow and hampers heat transfer combined with efforts to remove the frost further degrade the energy efficiency of the OVDC. There is highly variable and non-uniform product temperature between the shelves (up to 10° F. in temperature variation between shelves). The "spilled" air into the supermarket ambient makes the supermarket (particularly near the OVDCs) uncomfortable for shoppers. This "spilled" air cannot be reclaimed by space or water heating systems and ends up as a space cooling load. Thus, there remains a need for an energy efficient and effective OVDC.

SUMMARY

An aspect of the present disclosure is a system for cooling a food product using radiant cooling, the system including an open vertical display case including a wall, a plurality of piping positioned in the wall and including a first refrigerant stream, and a refrigeration circuit including a second refrigerant stream, in which the plurality of piping is positioned within the wall and configured to cool the food product using radiant cooling. In some embodiments, the system also includes a coil and a fan, in which the first refrigerant stream is routed through the coil, the coil is configured to cool an air stream resulting in a cooled air stream, and the fan is configured to direct the cooled air stream to the food product to cool the food product using convective cooling. In some embodiments, the system also includes a phase change material, in which the first refrigerant stream and the second refrigerant stream are routed through the phase change material, the first refrigerant stream is in thermal contact with the phase change material and the second refrigerant stream, the second refrigerant stream is in thermal contact with the phase change material and the first refrigerant stream, and the phase change material acts as a thermal energy storage system. In some embodiments, the phase change material has a transition temperature below 0° C. In some embodiments, the phase change material is ammonium chloride (NH4Cl) and/or potassium chloride (KCl). In some embodiments, the phase change material is potassium fluoride tetrahydrate ($KF \cdot 4H_2O$), manganese nitrate hexahydrate ($Mn(NO_3)_2 \cdot 6H_2O$), calcium chloride hexahydrate ($CaCl_2 \cdot 6H_2O$), calcium bromide hexahydrate ($CaBr_2 \cdot 6H_2O$), lithium nitrate hexahydrate ($LiNO_3 \cdot 6H_2O$), sodium sulfate decahydrate ($Na_2SO_4 \cdot 10H_2O$), sodium carbonate decahydrate ($NaCo_3 \cdot 10H_2O$), sodium orthophosphate dodecahydrate ($Na_2HPO_4 \cdot 12H_2O$), and/or zinc nitrate hexahydrate ($Zn(NO_3)_2 \cdot 6H_2O$). In some embodiments, the refrigeration circuit includes a condenser, a compressor, and an expansion valve. In some embodiments, the condenser is configured to transfer heat from the first refrigerant stream to the building's heating system. In some embodiments, the condenser is configured to transfer heat from the first refrigerant stream to the water supply. In some embodiments, the wall is a vertical side of the open vertical display case. In some embodiments, the wall is a horizontal canopy of the open vertical display case.

An aspect of the present disclosure, a method for cooling a food product using radiant cooling in an open vertical display case, the method including positioning a plurality of piping comprising a first refrigerant stream through a wall of an open vertical display case and operating a refrigeration circuit comprising a second refrigerant stream, in which the positioning includes cooling the food product using radiant cooling. In some embodiments, routing the first refrigerant stream through a coil, cooling an air stream using the coil, resulting in a cooled airstream, and directing the cooled air stream to the food product using a fan, in which the directing includes cooling the food product using convective cooling. In some embodiments, the refrigeration circuit includes a condenser, a compressor, and an expansion valve. In some embodiments, the method includes connecting the condenser to a water supply, in which the connecting includes transferring heat from the second refrigerant stream to the water supply through the condenser. In some embodiments, connecting the condenser to a building heating system, in which the connecting includes transferring heat from the second refrigerant stream to the building heating system through the condenser. In some embodiments, the method includes utilizing a phase change material as a heat exchanger between the first refrigerant stream and the second refrigerant stream, in which the utilizing includes storing thermal energy in the phase change material. In some embodiments, the phase change material includes a transition temperature below 0° C. In some embodiments, the wall is a vertical side of the open vertical display case. In some embodiments, the wall is a horizontal canopy of the open vertical display case.

BRIEF DESCRIPTION OF THE DRAWINGS

Some embodiments of the present disclosure are illustrated in the referenced figures of the drawings. It is intended that the embodiments and figures disclosed herein are to be considered illustrative rather than limiting.

REFERENCE NUMBERS

Figure 1:
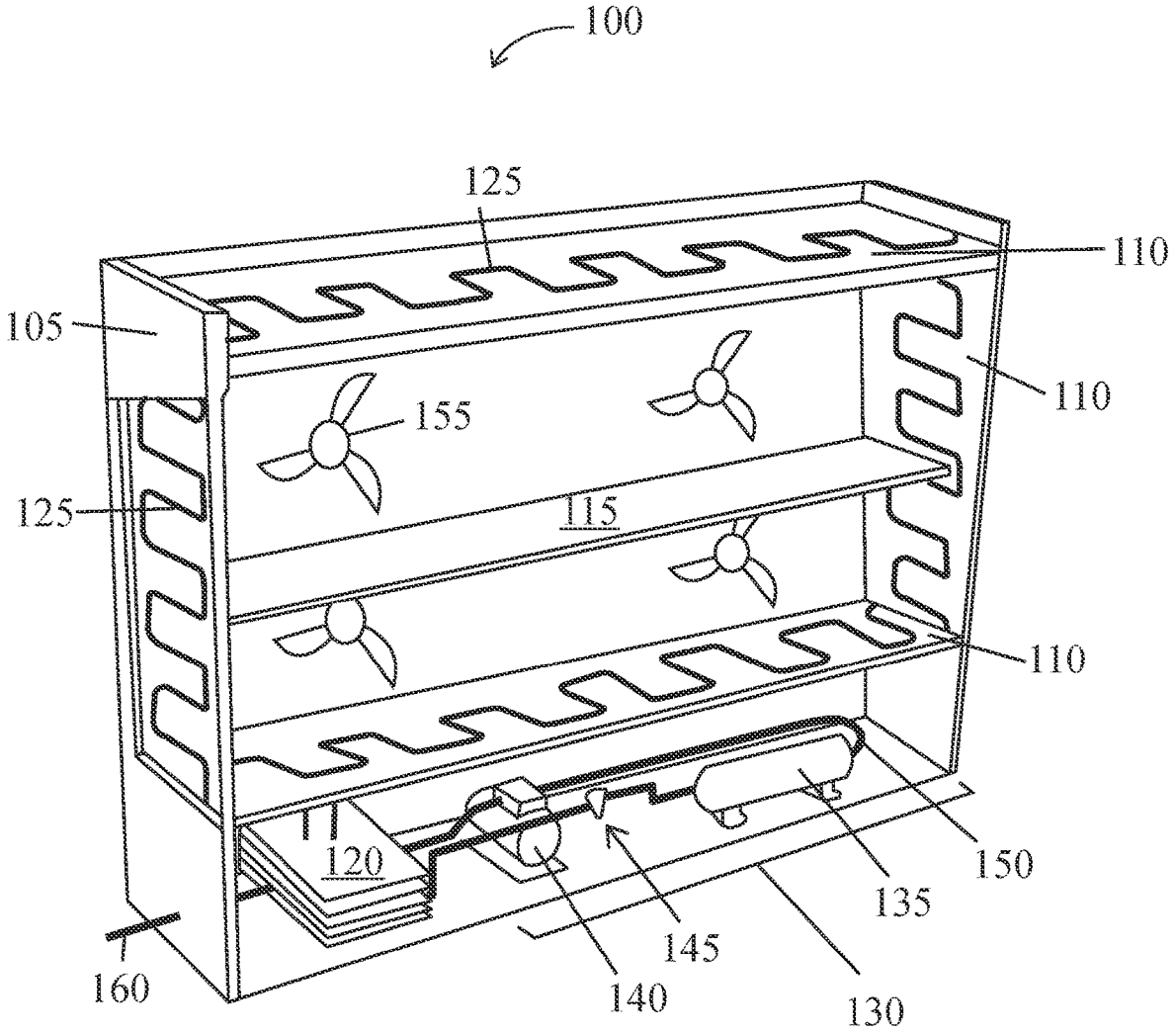
FIG. 1 illustrates an improved open vertical display case (OVDC) system using radiant cooling, according to some aspects of the present disclosure.

100 . . . system
105 . . . open vertical display case (OVDC)
110 . . . wall
115 . . . shelf
120 . . . phase change material
125 . . . plurality of piping
130 . . . refrigeration circuit
135 . . . condenser
140 . . . compressor
145 . . . expansion valve
150 . . . second refrigerant stream
155 . . . fan
160 . . . connection
165 . . . first refrigerant stream
170 . . . valve
175 . . . coil
180 air stream
185 . . . pump
190 . . . return air grille
195 . . . cooled air stream
200 . . . food product
300 . . . method
305 . . . positioning
310 . . . operating
315 . . . routing
320 . . . cooling
325 . . . directing
330 . . . connecting
335 . . . routing

DESCRIPTION

The embodiments described herein should not necessarily be construed as limited to addressing any of the particular problems or deficiencies discussed herein. References in the specification to "one embodiment", "an embodiment", "an example embodiment", "some embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used herein the term "substantially" is used to indicate that exact values are not necessarily attainable. By way of example, one of ordinary skill in the art will understand that in some chemical reactions 100% conversion of a reactant is possible, yet unlikely. Most of a reactant may be converted to a product and conversion of the reactant may asymptotically approach 100% conversion. So, although from a practical perspective 100% of the reactant is converted, from a technical perspective, a small and sometimes difficult to define amount remains. For this example of a chemical reactant, that amount may be relatively easily defined by the detection limits of the instrument used to test for it. However, in many cases, this amount may not be easily defined, hence the use of the term "substantially". In some embodiments of the present invention, the term "substantially" is defined as approaching a specific numeric value or target to within 20%, 15%, 10%, 5%, or within 1% of the value or target. In further embodiments of the present invention, the term "substantially" is defined as approaching a specific numeric value or target to within 1%, 0.9%, 0.8%, 0.7%, 0.6%, 0.5%, 0.4%, 0.3%, 0.2%, or 0.1% of the value or target.

As used herein, the term "about" is used to indicate that exact values are not necessarily, attainable. Therefore, the term "about" is used to indicate this uncertainty limit. In some embodiments of the present invention, the term "about" is used to indicate an uncertainty limit of less than or equal to ±20%, ±15%, ±10%, ±5%, or ±1% of a specific numeric value or target. In some embodiments of the present invention, the term "about" is used to indicate an uncertainty limit of less than or equal to ±1%, ±0.9%, ±0.8%, ±0.7%, ±0.6%, ±0.5%, ±0.4%, ±0.3%, ±0.2%, or ±0.1% of a specific numeric value or target.

The present disclosure relates to an improved open vertical display case (OVDC) which utilizes radiant cooling to cool and/or maintain food products at a target temperature. The radiant cooling is performed using a plurality of piping routed through the walls and containing a first refrigerant stream, which may be very cold. In some embodiments, convective cooling may also be performed using a fan directing air cooled by the first refrigerant stream flowing through a coil to the OVDC. The plurality of piping may be cooled using a refrigeration circuit. In some embodiments, a phase change material may be used for thermal energy storage and positioned between the plurality of piping and the refrigeration circuit. In some embodiments, the refrigeration circuit may be connected to heating ventilation and air conditioning (HVAC) systems and water heating systems within the building. The improved OVDC as described herein may be more energy efficient, may be able to serve as a flexible grid resource, and may be able to contribute heat to other building applications.

In some embodiments, the improved OVDC which makes the display portion (i.e., the food product shelves) the central components of a refrigeration system and integrates with HVAC systems and water heating systems within the building. The systems described herein may allow the improved OVDC to serve as a flexible grid resource and respond to demand response events and/or participate in load shaving/shifting strategies for the building. For example, the phase change material may act as both a heat exchanger and a thermal energy storage system and may be used to supply cooling without needing electrical power to run the refrigeration circuit. The improved OVDC may also utilize an improved cooling mechanism using radiant and (in some embodiments) low-airflow convective cooling.

FIG. 1 illustrates an improved open vertical display case system 100 using radiant cooling, according to some aspects of the present disclosure. The system 100 includes the improved OVDC 105, which contains several walls 110. A plurality of piping 125 is routed through the walls 110, performing radiant cooling on products on the shelf 115. The plurality of piping 125 contains the first refrigerant stream (not shown in FIG. 1), In some embodiments, fans 155 are located at the rear of the shelf 115 and may be directed to flow cooled air over the shelf 115. The air may be cooled using a coil (not shown in FIG. 1). In the lower portion of the improved OVDC 110, the refrigeration circuit 130 is located. The refrigeration circuit 130 includes a condenser 135, a compressor 140, and an expansion valve 145. A second refrigerant stream 150 circulates through the refrigeration circuit 130. In some embodiments, a phase change material 120 acts as a heat exchanger between the first refrigerant stream (not shown in FIG. 1) and the second refrigerant stream 150. The phase change material 120 may also perform thermal energy storage and allow the improved OVDC 105 to be operated even if the refrigeration circuit 130 is "turned off" or disconnected from electrical power (such as for grid-shifting purposes or emergency power outages).

The improved OVDC 105 may be operated at a thermostatic set point, based on the food products it is designed to contain on the shelf 115. Food products may be placed on the shelf 115, which through the radiant cooling emitted by the first refrigerant stream in the plurality of piping 125 may be maintained at a desired temperature (e.g., 34° F.). The lower portion of the improved OVDC 105 may include a refrigeration circuit 130 to extract heat from the first refrigerant stream to maintain the thermostatic set point of the improved OVDC 105. This refrigeration circuit 130 may reclaim this heat for space and water heating of the entire building (i.e., supermarket), improving overall building energy efficiency (via connection 160). During demand response events and/or as a part of a load shaving/shifting strategy the phase change material 120 may keep food products at the desired cooled temperature without the use of electrical energy.

The improved. OVDC 105 lacks the "air curtain" typical in most OVDCs, which is a major source of wasted energy and infiltration of warm air into the cooled food product area. Additionally, the improved OVDC 105 also lacks the evaporator coil typical in most OVDCs, which is a source of frost and its significant adverse repercussions on thermal performance. In some embodiments, the improved OVDC 105 uses radiant cooling coupled with low air-flow convective cooling n some embodiments, the low air-flow convective cooling may be introduced by a fan 155 through small perforations on the back interior wall 110 of the improved OVDC 105. The cooled air may "wrap around" food products on the shelf 115. The low-airflow cooled air may travel horizontally across the shelf 115 and/or vertically between the shelves 115. The shelves 115 may be made of a perforated/porous (i.e., "breathable") material such as mesh, wire, or chain-link material to allow cooled air to easily circulate through the improved OVDC 105. Simultaneously, radiant cooling may supplement the low air flow mechanism to further ensure the improved OVDC 105 is maintained at the thermostatic set point. Depending on the safety requirements of the food products to be stored in the improved OVDC 105, the thermostatic set point may be set to just above freezing. A small pump (not shown in FIG. 1) may circulate the first refrigerant stream through the plurality of piping 125 within the walls 110 (i.e., vertical walls) and canopy (i.e., horizontal wall 110) and within the phase change material 120 of the improved OVDC 105. Both cooling mechanisms (i.e., radiant cooling and convective cooling) of the improved OVDC 105 utilize the stored cooling energy of the phase change material 120.

In some embodiments, a wall 110 may be made of a substantially conductive material on the interior side (i.e., on the side oriented towards the food product or shelf 115). Examples of substantially conductive materials include aluminum, copper, steel, and/or plastic. A wall 110 may have an exterior side (i.e., the exterior of the improved OVDC 105) made of a substantially insulative material. Examples of a substantially insulative material include plastic, fiberglass, mineral wool, polyurethane foam, and/or concrete. A wall 110 may refer to a vertical side (i.e., a vertical wall) and/or a horizontal side (i.e., a canopy, shelf 115, or floor of the display area).

In some embodiments, the plurality of piping 125 may be made of a substantially conductive material, such as aluminum, copper, steel, and/or plastic. In some embodiments, the plurality of piping 125 may be in physical contact with a wall 110. The plurality of piping 125 may "zig-zag" or curve back and forth through the wall 110, to provide multiple sources of radiant cooling.

Figure 2:
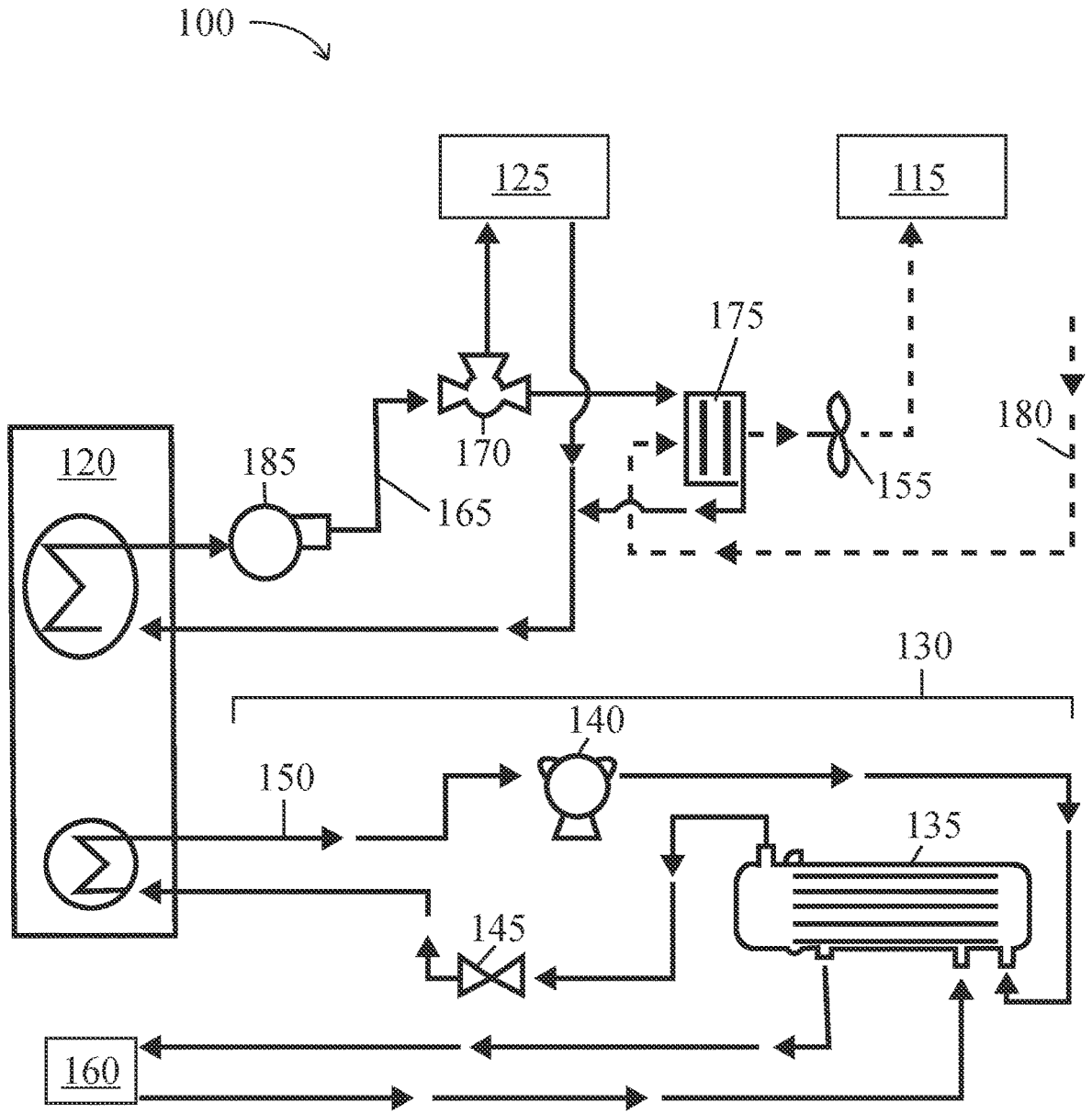
FIG. 2 illustrates a flow diagram for the improved OVDC system using radiant cooling, according to some aspects of the present disclosure.

FIG. 2 illustrates a flow diagram for the improved OVDC system 100 using radiant cooling, according to some aspects of the present disclosure. As shown in FIG. 2, the first refrigerant stream 165 is routed to the phase change material 120, where it is cooled. A pump 185 may be used to direct the first refrigerant stream 165. A valve 170 may direct a first portion of the first refrigerant stream 165 to the plurality of piping 125 and a second portion of the first refrigerant stream 165 to a coil 175. Then both the first portion and the second portion of the first refrigerant stream 165 may be routed back to the phase change material 120. An air stream 180 may be directed to flow through the coil 175 and a fan 155 may direct the air stream 180 to the shelf 115.

FIG. 2 also shows the path of the second refrigerant stream 150 through the refrigeration circuit 130. The second refrigerant stream 150 is routed through a compressor 140, then a condenser 135. In the condenser 135, the second refrigerant stream 150 is cooled. The heat released from the second refrigerant stream 150 in the condenser 135 may be directed to the building's heating system or water supply (via connection 160). That is, the heat removed from the second refrigerant stream 150 may be "recycled" or reused for other, practical uses within the building.

The first refrigerant stream 165 and/or the second refrigerant stream 150 may be any liquid material capable of transferring heat, such as water, glycol, hydrocarbons, hydrofluorocarbons, carbon dioxide, ammonia, haloalkanes, propane, and/or isobutane. In some embodiments, the first refrigerant stream 165 may be a "safer" material (meaning it is less toxic or non-toxic) than the second refrigerant stream 150, given the proximity of the first refrigerant stream 165 to food products. In some embodiments, the first refrigerant stream 165 may be cooled by the phase change material 120 and/or the second refrigerant stream 150 to a temperature in the range of about −5° C. to about 5° C. For optimal performance of the improved OVDC 105 and maintaining product temperatures to within limits set by the U.S. Food and Drug Administration, the first refrigerant stream 165 may be cooled to a temperature in the range of about −0.5° C. to about 0.5° C.

As shown in FIGS. 1-2, the phase change material 120 can act as a heat exchanger, facilitating the removal of heat from the first refrigerant stream 165 to the second refrigerant stream 150 (i.e., the refrigeration circuit 130). Additionally, the phase change material 120 may act as a thermal energy storage system and may be capable of removing heat from (i.e., cooling) the first refrigerant stream 165, allowing the improved OVDC 105 to continue to operate without the refrigeration circuit 130 flowing. Because the refrigeration circuit 130 requires electrical energy to operate, using the phase change material 120 to remove heat from the first refrigerant stream 165, the improved OVDC 105 can operate without electrical energy for a short period of time (for example, 3 hours). For example, the phase change material 120 could "power" the improved OVDC 105 during power outages or as a scheduled grid/load shifting.

Figure 3:
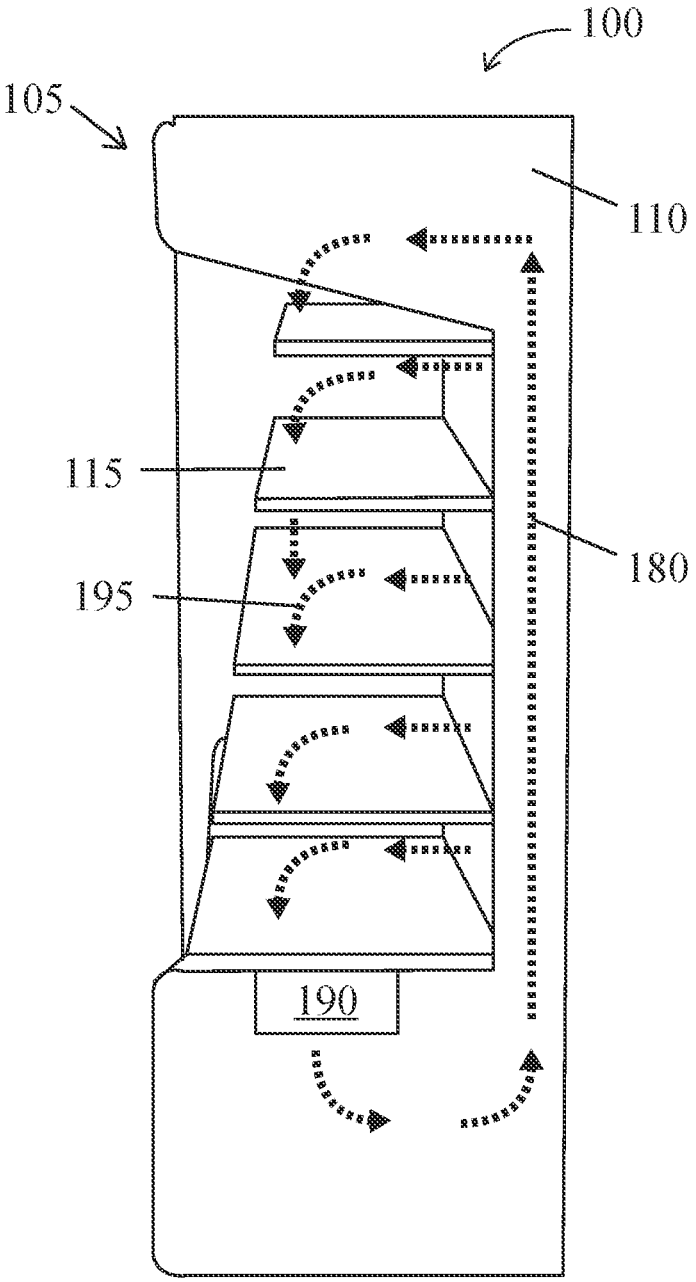
FIG. 3 illustrates the flow of air through the improved OVDC system using radiant cooling, according to some aspects of the present disclosure.

FIG. 3 illustrates the flow of air through the improved open vertical display case system 100 using radiant cooling, according to some aspects of the present disclosure. As shown in FIG. 3, in the improved OVDC 105 has a return air grilled 190, which may be located at the bottom of the food product area (i.e., under the lowest shelf 115). An air stream 180 may be routed up the rear of the improved OVDC 105, A coil 175 (not shown in FIG. 3, see FIGS. 1-2) containing the first refrigerant stream 165 (not shown in FIG. 3, see FIGS. 1-2) cool the air stream 180, creating a cooled air stream 195. A fan 155 (not shown in FIG. 3, see FIGS. 1-2) directs the cooled air stream 195 to the area just above a shelf 115. In some embodiments, there may be at least one fan 155 corresponding to each shelf 115 in the improved OVDC 105. The shelves 115 may be made of a substantially air-permeable material, allowing the cooled air stream 195 to travel through the food products (not shown) on the shelves 115, through the shelves 115, and down to the return air grille 190.

Figure 4:
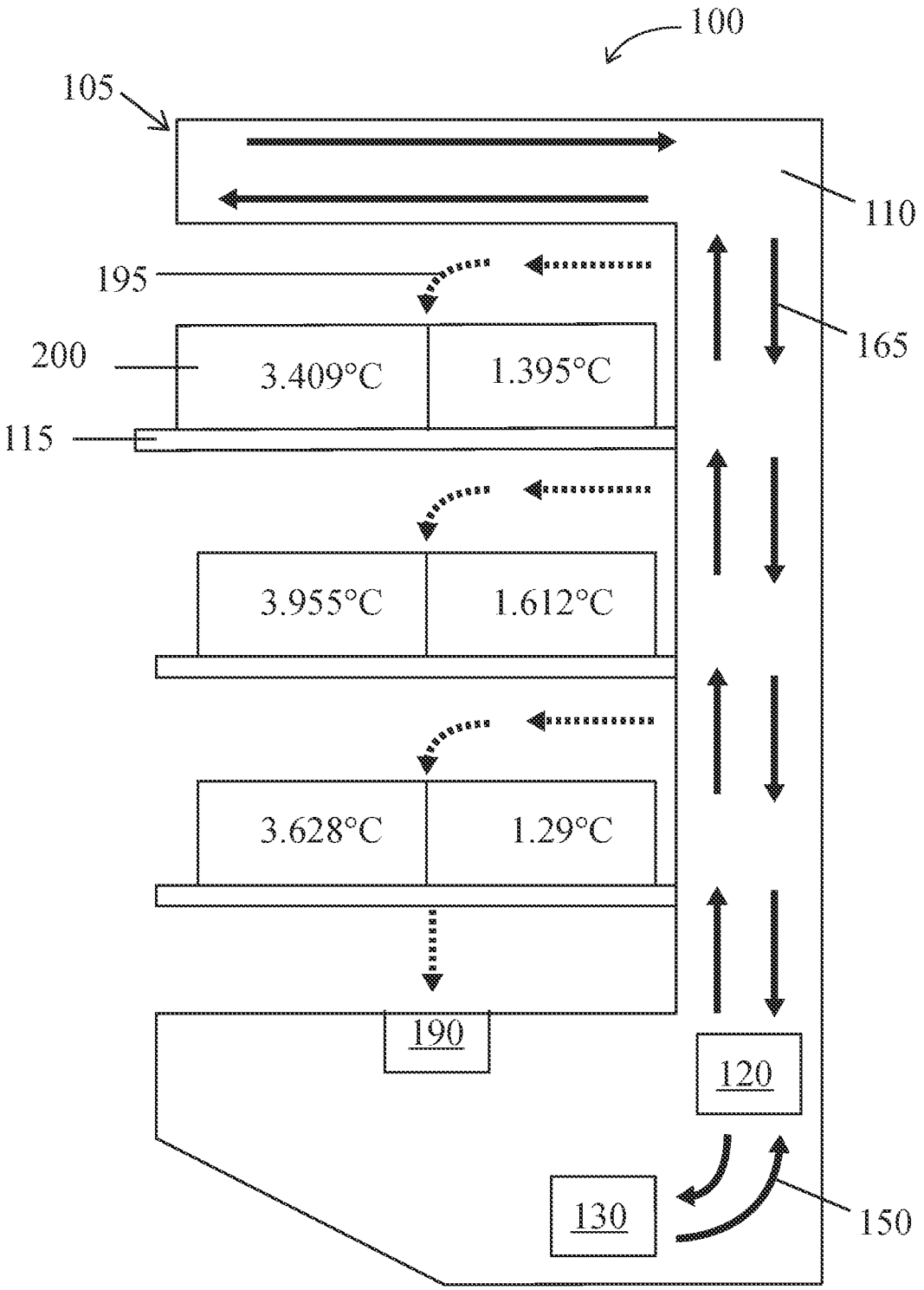
FIG. 4 illustrates air flow, refrigerant flow, and core product temperatures for food products stored in the improved OVDC using radiant cooling, according to some aspects of the present disclosure.

FIG. 4 illustrates airflow, refrigerant flow, and core product temperatures for food products 200 stored in the improved OVDC 105 using radiant cooling, according to some aspects of the present disclosure. The cooled air stream 195 path is shown only in the shelf 115 area. The fans 155 are not shown in FIG. 4, but the cooled air stream 195 is directed to the food products 200 using the fans 155. The cooled air stream 195 is then collected by the return air grille 190 (see FIG. 3). The first refrigerant 165 path is shown throughout the wall 110. The first refrigerant stream 165 is cooled in the phase change material 120 (by the phase change material 120 and/or the second refrigerant stream 150), then routed up the wall 110 (the wall 110 includes both vertical and horizontal walls 110) before returning to the phase change material 120. The second refrigerant stream 165 is circulated through the refrigeration circuit 130 and cools the phase change material 120 and/or the first refrigerant stream 165 in the phase change material 120.

The core food product 200 temperatures are shown in FIG. 4, as calculated using modeling. The core food product 200 temperatures in FIG. 4 are based on the first refrigerant stream 165 being cooled to approximately 0.1° C. (or approximately 32.2° F.) in the phase change material 120. That is, the first refrigerant stream 165 leaves the phase change material 120 at a temperature of approximately 0.1° C. While being routed through the wall 110 in the plurality of piping 125 (not shown in FIG. 4, see FIG. 1) the first refrigerant stream 165 may be heated to approximately 0.5° C. For example, some modeling had the first refrigerant stream 165 reaching a temperature of approximately 0.48° C. after cooling food products 200 on three shelves 115 using radiant cooling through the walls 110 and convective cooling through a coil 175 and fan 155. The core food product 200 temperatures shown in FIG. 4 show that the improved OVDC 105 may result in a difference in the warmest food product 200 and the coolest food product 200 (i.e., ΔT) of less than approximately 3° C. For example, some modeling showed a ΔT of approximately 2.67° C.

The improved OVDC 105 shown in FIGS. 1-4 lacks the "air curtain" standard in traditional OVDCs, which blows cold air from the front top portion of the traditional OVDC to a return air grille positioned at the front bottom of the traditional OVDC. In most traditional OVDCs, the air curtain is the primary (if not only) source of cooling, and leads to significant energy losses, most due to the infiltration of warm, moist air from external to the traditional OVDC. This infiltrated air may also be entrained by the air curtain, and "pulled" back into the shelves and product area. The improved OVDC 105 lacks the air curtain and using radiant cooling through the plurality of piping 125 as the primary means of cooling/maintaining food products at appropriate temperatures.

Figure 5:
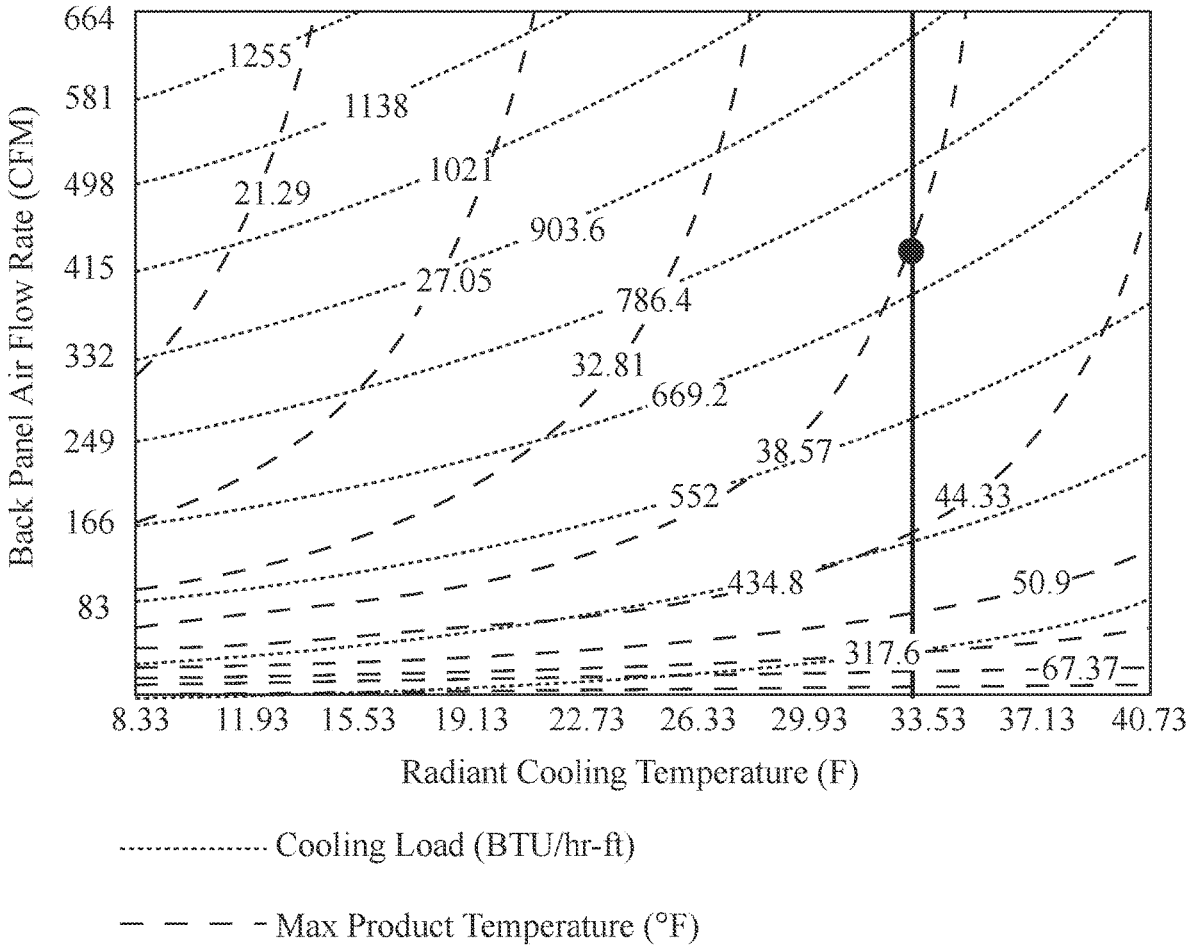
FIG. 5 illustrates total cooling load and maximum core food product temperature contour lines based on radiant cooling temperature and back panel air flow of the improved OVDC using radiant cooling, according to some aspects of the present disclosure.

FIG. 5 illustrates total cooling load and maximum core food product temperature contour lines based on radiant cooling temperature and back panel air flow of the improved OVDC, according to some aspects of the present disclosure. The dotted line is cooling load (units: BTU/hr-ft) and the dashed line is maximum food product 200 core food product temperature (units: ° F.), The core product temperature needs to maintained at about 41° F. or below to comply with U.S. Food and Drug Administration regulations. Too cold, however, and frost may form on the interior surfaces of the improved OVDC 105. An optimum operational point of the improved. OVDC 105 is shown as a solid circle in FIG. 5. At that point, having a radiant cooling temperature of approximately 32° F. (i.e., the temperature of the first refrigerant stream 165 when leaving the phase change material 120) and a back panel airflow rate (i.e., the flow rate of the cooled air stream 195 when directed/pushed by the fan 155) of approximately 415 CFM (cubic feet per minute).

Figure 6:
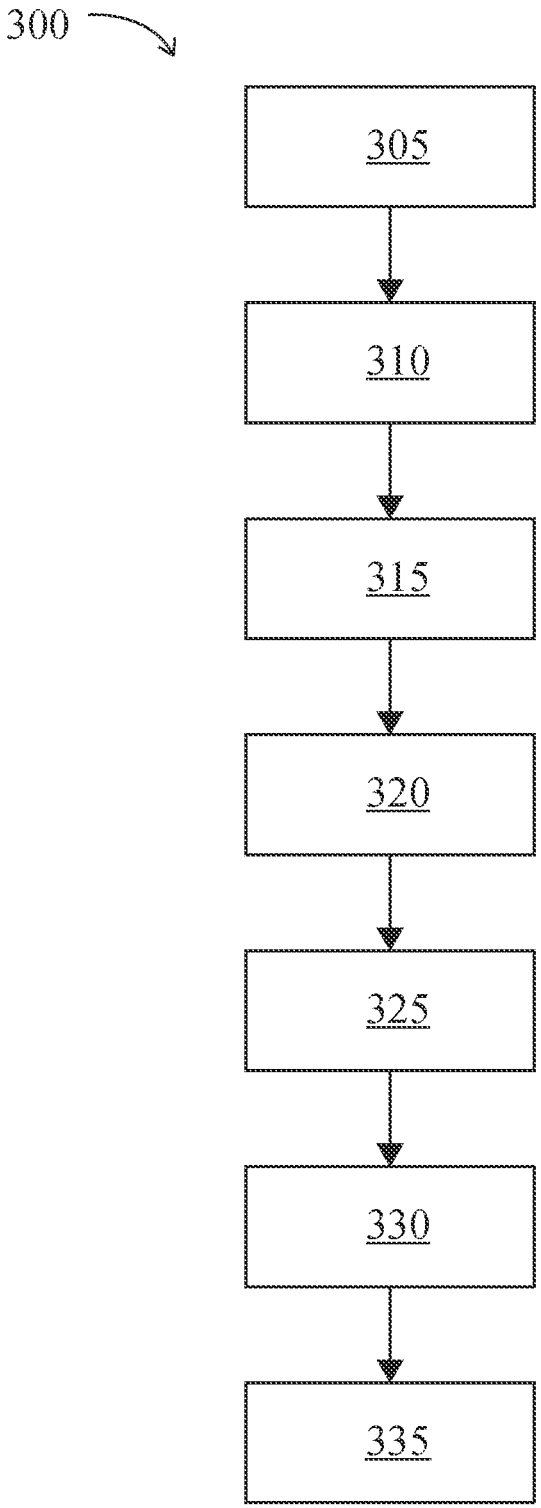
FIG. 6 illustrates a method for cooling at least one food product using radiant cooling in an improved OVDC, according to some aspects of the present disclosure.

FIG. 6 illustrates a method 300 for cooling at least one food product using radiant cooling in an improved OVDC 105, according to some aspects of the present disclosure. The method includes positioning 305 a plurality of piping 125 containing a first refrigerant stream 165 in a wall 110 of the improved OVDC 105 and then operating a refrigeration circuit 130 containing a second refrigerant stream 150. The food product 200 may be cooled using radiant cooling emitted from the first refrigerant stream 165 in the plurality of piping 125.

In some embodiments, the method 300 also includes routing 315 the first refrigerant stream 165 through a coil 175, cooling 320 an air stream 180 using the coil 175 (resulting in a cooled airstream 195), and directing 325 the cooled air stream 195 to the food product 200 using a fan 155. The directing 325 includes cooling the food product 200 using convective cooling. The convective cooling and radiant cooling may be combined to defectively cool the food products or maintain the temperature of the food products at acceptable temperatures (i.e., temperatures regulated by the U.S. Food and Drug Administration), In some embodiments, at least one fan 155 may be present for each shelf 115 in the improved OVDC 105, In other embodiments, the number of fans may be less than or greater than the number of shelves 115 in the improved OVDC. The fans may be operated using electrical energy.

In some embodiments, the method 300 also includes connecting 330 the condenser 135 to the building water supply and/or the building heating system. Waste heat from the condenser may be used by the building's water supply or heating system (i.e., heating ventilation and air conditioning (HVAC) system). The connecting 330 may be done by directing a third refrigerant stream through the condenser, which can transfer the waste heat to the water supply or heating system. Alternatively, the connecting 330 may be done by routing the water supply or building air through the condenser to recover the waste heat directly.

In some embodiments, the method 300 also includes utilizing 335 a phase change material 120 as a heat exchanger between the first refrigerant stream 195 and the second refrigerant stream 150. The utilizing 335 may also including storing thermal energy in the form of cold energy in the phase change material 120. In some embodiments, for example, during off-peak hours, the refrigeration circuit 130 may "charge" freeze) the phase change material 120, then, during on-peak hours, the refrigeration circuit 130 may be turned off or turned down and the phase change material 120 may cool the first refrigerant stream 165. This allows the improved OVDC 105 to operate with significantly lower (if not no) energy from the electrical grid.

In some embodiments, the phase change material 120 may have a transition temperature (i.e., a temperature at which the phase change material 120 changes phase between solid and liquid) below 32° F. (0° C.) to achieve desired refrigeration requirements for food products. In some embodiments, the phase change material 120 may have high thermal conductivity (i.e., greater than about 10 W/m-K) to enable rapid charge/discharge times. In some embodiments, the phase change material 120 may have sufficient energy density (i.e., a heat of fusion greater than about 55 $kWh/m^3$) to enable advanced refrigeration load flexibility capabilities. In some embodiments, the phase change material 120 may have stability over multiple cycles. Examples of phase change material 120 may include inorganic phase change materials such as salt-water eutectic solutions or salt hydrates. Some examples of phase change material 120 include ammonium chloride ($NH_4Cl$) and/or potassium chloride (KCl). In some embodiments, the phase change material 120 may be a salt hydrate. Examples of salt hydrates include potassium fluoride tetrahydrate ($KF{\cdot}4H_2O$), manganese nitrate hexahydrate ($Mn(NO_3)_2{\cdot}6H_2O$), calcium chloride hexahydrate ($CaCl_2{\cdot}6H_2O$), calcium bromide hexahydrate ($CaBr_2{\cdot}6H_2O$), lithium nitrate hexahydrate ($LiNO_3{\cdot}6H_2O$), sodium sulfate decahydrate ($Na_2SO_4{\cdot}10H_2O$), sodium carbonate decahydrate ($NaCo_3{\cdot}10H_2O$), sodium orthophosphate dodecahydrate ($Na_2HPO_4{\cdot}12H_2O$), or zinc nitrate hexahydrate ($Zn(NO_3)_2{\cdot}6H_2O$). In some embodiments, inorganic phase change materials may require surface modification of the expanded graphite prior to compression to successfully impregnant the inorganic phase change material into treated graphite structures, such as graphite matrices.

EXAMPLES

Example 1

A system for cooling a food product using radiant cooling, the system comprising an open vertical display case comprising a wall;

a plurality of piping positioned in the wall and comprising a first refrigerant stream; and a refrigeration circuit comprising a second refrigerant stream; wherein the plurality of piping is positioned within the wall and configured to cool the food product using radiant cooling.

Example 2

The system of Example 1, further comprising:

a coil; and a fan; wherein:

the first refrigerant stream is routed through the coil, the coil is configured to cool an air stream resulting in a cooled air stream, and the fan is configured to direct the cooled air stream to the food product to cool the food product using convective cooling.

Example 3

The system of Examples 1 or 2, further comprising:

a phase change material; wherein:

the first refrigerant stream and the second refrigerant stream are routed through the phase change material, the first refrigerant stream is in thermal contact with the phase change material and the second refrigerant stream, the second refrigerant stream is in thermal contact with the phase change material and the first refrigerant stream, and the phase change material comprises a thermal energy storage system.

Example 4

The system of Example 3, wherein:

the phase change material comprises a transition temperature below 0° C.

Example 5

The system of any of Examples 1-4, wherein:

the phase change material is contained within a graphite matrix.

Example 6

The system of any of Examples 1-5, wherein:

the phase change material comprises an inorganic phase change material.

Example 7

The system of Example 6, wherein:

the inorganic phase change material comprises a salt hydrate.

Example 8

The system of Example 7, wherein:

the salt hydrate comprises at least one of potassium fluoride tetrahydrate ($KF{\cdot}4H_2O$), manganese nitrate hexahydrate ($Mn(NO_3)_2{\cdot}6H_2O$), calcium chloride hexahydrate ($CaCl_2{\cdot}6H_2O$), calcium bromide hexahydrate ($CaBr_2 \cdot 6H_2O$), lithium nitrate hexahydrate ($LiNO_3 \cdot 6H_2O$), sodium sulfate decahydrate ($Na_2SO_4 \cdot 10H_2O$), sodium carbonate decahydrate ($NaCo_3 \cdot 10H_2O$), sodium orthophosphate dodecahydrate ($Na_2HPO_4 \cdot 12H_2O$), or zinc nitrate hexahydrate ($Zn(NO_3)_2 \cdot 6H_2O$).

Example 9

The system of any of Examples 1-8, wherein:
the refrigeration circuit comprises:
a condenser
a compressor; and
an expansion valve.

Example 10

The system of Example 9, wherein:
the condenser is connected to a building's heating system.

Example 11

The system of any of Examples 1-10, wherein:
the condenser is configured to transfer heat from the first refrigerant stream to the building's heating system.

Example 12

The system of Example 9, wherein:
the condenser is connected to a water supply.

Example 13

The system of any of Examples 1-12, wherein:
the condenser is configured to transfer heat from the first refrigerant stream to the water supply.

Example 14

The system of Example 12, wherein:
the water supply is a potable water source.

Example 15

The system of any of Examples 1-14, wherein:
the wall comprises a vertical side of the open vertical display case.

Example 16

The system of any of Examples 1-15, wherein:
the wall comprises a horizontal canopy of the open vertical display case.

Example 17

The system of any of Examples 1-16, wherein:
the wall comprises a horizontal base of the open vertical display case.

Example 18

The system of any of Example 1-17, wherein:
the plurality of piping comprises copper piping.

Example 19

The system of any of Examples 1-18, wherein:
plurality of piping comprises piping comprising a conductive material.

Example 20

The system of any of Examples 1-19, wherein:
first refrigerant stream comprises glycol.

Example 21

The system of any of Examples 1-20, wherein:
the first refrigerant stream comprises water.

Example 22

The system of any of Examples 1-21, wherein:
the second refrigerant stream comprises at least one of a hydrocarbon or a hydrofluorocarbon.

Example 23

The system of any of Examples 1-22, wherein:
the second refrigerant stream comprises water.

Example 24

A method for cooling a food product using radiant cooling in an open vertical display case, the method comprising:
positioning a plurality of piping comprising a first refrigerant stream through a wall of an open vertical display case; and
operating a refrigeration circuit comprising a second refrigerant stream; wherein:
the positioning comprises cooling the food product using radiant cooling.

Example 25

The method of Example 24, further comprising:
routing the first refrigerant stream through a coil;
cooling an air stream using the coil, resulting in a cooled airstream; and
directing the cooled air stream to the food product using a fan; wherein:
the directing comprises cooling the food product using convective cooling.

Example 26

The method of Examples 24 or 25, wherein:
the refrigeration circuit comprises:
a condenser;
a compressor; and
an expansion valve.

Example 27

The method of Example 26, further comprising:
connecting the condenser to a water supply.

Example 28

The method of Example 27, wherein:
the connecting comprises transferring heat from the second refrigerant stream to the water supply through the condenser.

Example 29

The method of Example 27, wherein:
the water supply is a potable water source.

Example 30

The method of Example 26, further comprising:
connecting the condenser to a building heating system.

Example 31

The method of Example 30, wherein:
the connecting comprises transferring heat from the second refrigerant stream to the building heating system through the condenser.

Example 32

The method of any of Examples 24-31, further comprising:
utilizing a phase change material as a heat exchanger between the first refrigerant stream and the second refrigerant stream; wherein:
the utilizing comprises storing thermal energy in the phase change material.

Example 33

The method of any of Examples 24-32, wherein:
the phase change material comprises a transition temperature below 0° C.

Example 34

The method of any of Examples 24-33, wherein:
the phase change material comprises an inorganic phase change material.

Example 35

The method of Example 34, wherein:
the inorganic phase change material comprises a salt hydrate.

Example 36

The method of Example 35, wherein:
the salt hydrate comprises at least one of potassium fluoride tetrahydrate ($KF \cdot 4H_2O$), manganese nitrate hexahydrate ($Mn(NO_3)_2 \cdot 6H_2O$), calcium chloride hexahydrate ($CaCl_2 \cdot 6H_2O$), calcium bromide hexahydrate ($CaBr_2 \cdot 6H_2O$), lithium nitrate hexahydrate ($LiNO_3 \cdot 6H_2O$), sodium sulfate decahydrate ($Na_2SO_4 \cdot 10H_2O$), sodium carbonate decahydrate ($NaCo_3 \cdot 10H_2O$), sodium orthophosphate dodecahydrate ($Na_2HPO_4 \cdot 12H_2O$), or zinc nitrate hexahydrate ($Zn(NO_3)_2 \cdot 6H_2O$).

Example 37

The method of any of Examples 24-35, wherein:
the phase change material is contained within a graphite matrix.

Example 38

The method of any of Examples 24-37, wherein:
the wall comprises a vertical side of the open vertical display case.

Example 39

The method of any of Examples 24-38, wherein:
the wall comprises a horizontal canopy of the open vertical display case.

Example 40

The method of any of Examples 24-39, wherein:
the wall comprises a horizontal base of the open vertical display case.

Example 41

The method of any of Examples 24-40, wherein:
the plurality of piping comprises a conductive material.

Example 42

The method of any of Examples 24-41, wherein:
the conductive material comprises copper.

Example 43

The method of any of Examples 24-42, wherein:
first refrigerant stream comprises glycol.

Example 44

The method of any of Examples 24-43, wherein:
the first refrigerant stream comprises water.

Example 45

The method of any of Examples 24-44, wherein:
the second refrigerant stream comprises at least one of a hydrocarbon or a hydrofluorocarbon.

Example 46

The method of any of Examples 24-45, wherein:
the second refrigerant stream comprises water.

The foregoing discussion and examples have been presented for purposes of illustration and description. The foregoing is not intended to limit the aspects, embodiments, or configurations to the form or forms disclosed herein. In the foregoing Detailed Description for example, various features of the aspects, embodiments, or configurations are grouped together in one or more embodiments, configurations, or aspects for the purpose of streamlining the disclosure. The features of the aspects, embodiments, or configurations may be combined in alternate aspects, embodiments, or configurations other than those discussed above. This method of disclosure is not to be interpreted as reflecting an intention that the aspects, embodiments, or configurations require more features than are expressly recited in each claim. Rather, as the following claims reflect, inventive aspects lie in less than all features of a single foregoing disclosed embodiment, configuration, or aspect. While certain aspects of conventional technology have been discussed to facilitate disclosure of some embodiments of the present invention, the Applicants in no way disclaim these technical aspects, and it is contemplated that the claimed invention may encompass one or more of the conventional technical aspects discussed herein. Thus, the following claims are hereby incorporated into this Detailed Description, with each claim standing on its own as a separate aspect, embodiment, or configuration.

What is claimed is:

1. An open vertical display case (OVDC) comprising:

a backwall comprising perforations passing through the backwall;

a first side wall disposed adjacent to a first side of the backwall;

a second side wall disposed adjacent to a second side of the backwall;

a canopy disposed adjacent to a top of the backwall;

a base disposed adjacent to a bottom of the backwall;

a shelf disposed between and parallel to the canopy and the base, wherein the shelf is constructed of a perforated/porous material;

a fan disposed on the backwall to direct an air flow to a heat exchanger;

a phase change material (PCM) characterized by a high thermal conductivity and a high thermal energy storage;

a first refrigeration circuit comprising:

a first refrigerant;

first plurality of piping positioned within at least one the first side wall, the second side wall, the canopy, the base, or a combination thereof;

the first refrigerant is disposed in the first plurality of piping to cool food products on the shelf by radiant heat transfer; and the plurality of piping is configured to thermally contact the first refrigerant with the PCM; and a second refrigeration circuit comprising:

a second refrigerant; and a second plurality of piping configured to thermally contact the second refrigerant with the PCM, wherein:

the heat exchanger is disposed to cool the air flow by transferring heat from the air flow to the first refrigerant, forming a cooled air flow;

the fan and the backwall comprising perforations direct the cooled air flow through the perforations into the OVDC, and the backwall and the shelf direct the cooled air flow through the perforated/porous material of the shelf, such that the cooled air flow cools food products on the shelf by convective heat transfer.

2. The OVDC of claim 1, wherein the PCM comprises a transition temperature below 0° C.

3. The OVDC of claim 1, wherein the PCM comprises at least one of ammonium chloride ($NH_4Cl$) or potassium chloride (KCl).

4. The OVDC of claim 1, wherein the PCM comprises at least one of potassium fluoride tetrahydrate ($KF{\cdot}4H_2O$), manganese nitrate hexahydrate ($Mn(NO_3)_2{\cdot}6H_2O$), calcium chloride hexahydrate ($CaCl_2{\cdot}6H_2O$), calcium bromide hexahydrate ($CaBr_2{\cdot}6H_2O$), lithium nitrate hexahydrate ($LiNO_3{\cdot}6H_2O$), sodium sulfate decahydrate ($Na_2SO_4{\cdot}10H_2O$), sodium carbonate decahydrate ($NaCo_3{\cdot}10H_2O$), sodium orthophosphate dodecahydrate ($Na_2HPO_4{\cdot}12H_2O$), or zinc nitrate hexahydrate ($Zn(NO_3)_2{\cdot}6H_2O$).

5. The OVDC of claim 1, wherein food products on the shelf are cooled without an air curtain.

6. The OVDC of claim 1, comprising a temperature differential ($\Delta T$) of 3° C. or less between a temperature of a coolest food product on the shelf and a temperature of a warmest food product on the shelf.

7. The OVDC of claim 1, wherein the first refrigeration system lacks an evaporator.

8. The OVDC of claim 1, wherein the perforated/porous material comprises at least one of a mesh material, a wire material, a chain-link material, or a combination thereof.

9. The OVDC of claim 1, wherein at least one of the first side wall, the second side wall, the canopy, the base, or a combination thereof comprises an interior side constructed of a conductive material.

10. The OVDC of claim 9, wherein the conductive material comprises at least one of aluminum, copper, a steel, a plastic, or a combination thereof.

11. The OVDC of claim 9, wherein at least one of the first side wall, the second side wall, the canopy, the base, or a combination thereof further comprises an exterior side constructed of an insulative material.

12. The OVDC of claim 11, wherein the insulative material comprises ate least one of a plastic, a fiberglass, mineral wool, a polyurethane foam, concrete, or a combination thereof.

13. The OVDC of claim 1, wherein the plurality of piping of the first refrigeration circuit is positioned to curve back and forth within the at least one of the first side wall, the second side wall, the canopy, the base, or a combination thereof.

14. The OVDC of claim 1, wherein the cooled air flow is between greater than zero cubic feet per minute (CFM) and 664 CFM.

* * * * *